United States Patent [19]

Shnitkin et al.

[11] Patent Number: 5,027,127

[45] Date of Patent: Jun. 25, 1991

[54] PHASE ALIGNMENT OF ELECTRONICALLY SCANNED ANTENNA ARRAYS

[75] Inventors: Harold Shnitkin, Roslyn, N.Y.; Glenn B. Harrison, Fairfield, Conn.

[73] Assignee: United Technologies Corporation, Hartford, Conn.

[21] Appl. No.: 786,388

[22] Filed: Oct. 10, 1985

[51] Int. Cl.[5] ..... H01Q 3/30

[52] U.S. Cl. ..... 342/372; 342/174

[58] Field of Search ..... 343/369, 372; 342/369, 342/372, 173, 174, 169, 368, 371, 372

[56] References Cited

U.S. PATENT DOCUMENTS

| | | | |
|---|---|---|---|
| 3,312,972 | 4/1967 | Alitz . | |
| 4,053,890 | 10/1977 | Woodson, III et al. . | |
| 4,060,806 | 11/1977 | Davies et al. . | |
| 4,176,354 | 11/1979 | Hsiao et al. | 342/173 |
| 4,348,676 | 9/1982 | Tom | 343/369 X |
| 4,394,659 | 7/1983 | Gellekink . | |
| 4,394,660 | 7/1983 | Cohen | 343/369 |
| 4,484,194 | 11/1984 | Arvidsson | 342/174 |
| 4,488,155 | 12/1984 | Wu | 342/376 |
| 4,492,962 | 1/1985 | Hansen | 343/369 |
| 4,635,060 | 1/1987 | Mertens | 342/194 |
| 4,639,732 | 1/1987 | Acoraci et al. | 342/371 |
| 4,642,642 | 2/1987 | Uurtamo | 342/165 |
| 4,660,041 | 4/1987 | Maples et al. | 342/170 |

OTHER PUBLICATIONS

Dan Davis, "Analysis of Array Antenna Patterns During Test", Microwave Journal, Feb. 1978; pp. 67, 68 and 70.

*Primary Examiner*—Gilberto Barron, Jr.
*Assistant Examiner*—John B. Sotomayor

[57] ABSTRACT

A built-in coupling means (14) for coupling test signals to an electronically scanned antenna (13), thereby permitting the iterative establishment of corrected phase setting on individual phasers (19') associated with respective radiation elements (17) in said antenna (13).

2 Claims, 2 Drawing Sheets

PHASE ALIGNMENT OF ELECTRONICALLY SCANNED ANTENNA ARRAYS

The Government has rights in this invention pursuant to Contract No. DAA K20-83-C-0892 awarded by the Department of the Army.

TECHNICAL FIELD

This invention is directed toward the technical field of electronically scanned antenna arrays, and more particularly toward the technical field of phase alignment of electronically phase scanned antenna arrays used in radar systems.

BACKGROUND ART

Electronically scanned antenna arrays are well known, as suggested in chapter 11 of Radar Handbook (McGraw-Hill, 1970; M. I. Skolnik, Ed.). Such kinds of antennae are frequently used in radar systems. The antennae used particularly comprise arrays of individual radiating elements, which are electronically phase scanned.

The manufacture and assembly of such an antenna nonetheless remains a difficult task. Substantial errors in the phase of individual elements of the array are created even if manufacture is conducted within acceptable manufacturing tolerances. These errors may accumulate, resulting in overall antenna aperture phase errors.

Accordingly, at first manufacture and assembly, an initial antenna aperture phase measurement is conducted and suitable corrections and adjustments in the manufactured antenna are introduced. The initial measurement consists of accurately measuring the radiated phase of each antenna array element by near-field probing. Then phase correction for the relative errors in phase between respective elements is made, by introducing adjustment factors into the memory of the computer directing the electronic beam steering phasers.

In particular, the radiated phase and amplitude of every element of the array are individually examined to determine deviation from design parameters. These errors can be mechanically or electrically eliminated by making suitable adjustments.

To produce a low sidelobe antenna radiation pattern, laborious precision measurements and adjustments are made in a test laboratory. These adjustments require physical access to the antenna radiating surface in many cases.

However, even after initial adjustment, phase deviations continue to affect performance as a result of environmental factors, component failure and component replacement. In other words, the tight phase tolerances of the antenna aperture degrade, creating phase errors, largely caused by aging, deformation, and component replacement activities. The necessary phase corrections are typically conducted by returning the antenna to an antenna test site on calibration laboratory or phase realignment. In lieu of such involved procedures, it is considered beneficial to make phase corrections, while the antenna is operating on-line during flight operations, for example.

No technique accomplishing this objective is known at this time, which is effective in precisely the same fashion as the invention herein sets forth. However, one phase/amplitude aperture measuring technique for an electronically phased array is known which is relevant as background to the invention presented herein. This technique does not require access to the antenna radiating surface. This technique is effectively described by Mr. Dan Davis in the February 1978 issue of the Microwave Journal. Mr. Davis' method requires that the antenna be installed on a precision rotating positioner while receiving a far-field radiated signal. Antenna phase and amplitude values received at the antenna input port are then accurately measured for prescribed angular positions of the rotating antenna positioner. One position is employed for each radiating element in the antenna array.

Subsequent computation by means of a relatively simple algorithm generates radiated phase and amplitude values of every element of the antenna array. Addition of the negated values of the measured degrees of phase and of the amount of amplitude deviation to each element excitation voltage results in an optimized, minimum-sidelobe antenna.

However, instead of conducting such measurements in a laboratory or as described in the Davis article, it is desirable to perform them right in the aircraft under operational conditions.

BRIEF SUMMARY OF THE INVENTION

According to the invention, a loosely coupled, constant-amplitude, linear phase traveling-feed, also known as a BITE ("Built-in Test Equipment") coupler system, is attached to the rear of a row of radiating elements of an electronically-phased array antenna to distribute equal amounts of radio frequency (RF) energy, to each radiating element with a constant phase differential between all adjacent elements, from a test generator. The complex voltage signals received at the antenna input port are recorded for a predetermined number of electronic scan angles.

This recorded information is then subjected to a complex-variable matrix inversion, which produces phase and amplitude indications for each radiating element, the negative of the phase values thus established constituting the desired correction factor to be supplied to the beam steering computer.

Thus, according to the invention, tight phase tolerances are automatically established for the antenna aperture, in order to establish low sidelobes for the phased array antenna.

Alignment is accomplished by conducting phase and amplitude measurements at the antenna receive port with a coupling device according to the invention. Certain computations are conducted, generating phase and amplitude corrections for each element in the antenna array. These corrections are applied to the antenna through a beam steering computer. This results in a low sidelobe radiation pattern.

According to the invention, this self-test and phase correction process can be performed while the antenna is mounted on a moving platform during normal operation.

DETAILED DESCRIPTION OF A BEST MODE OR PREFERRED EMBODIMENT OF THE INVENTION

Figure 1:
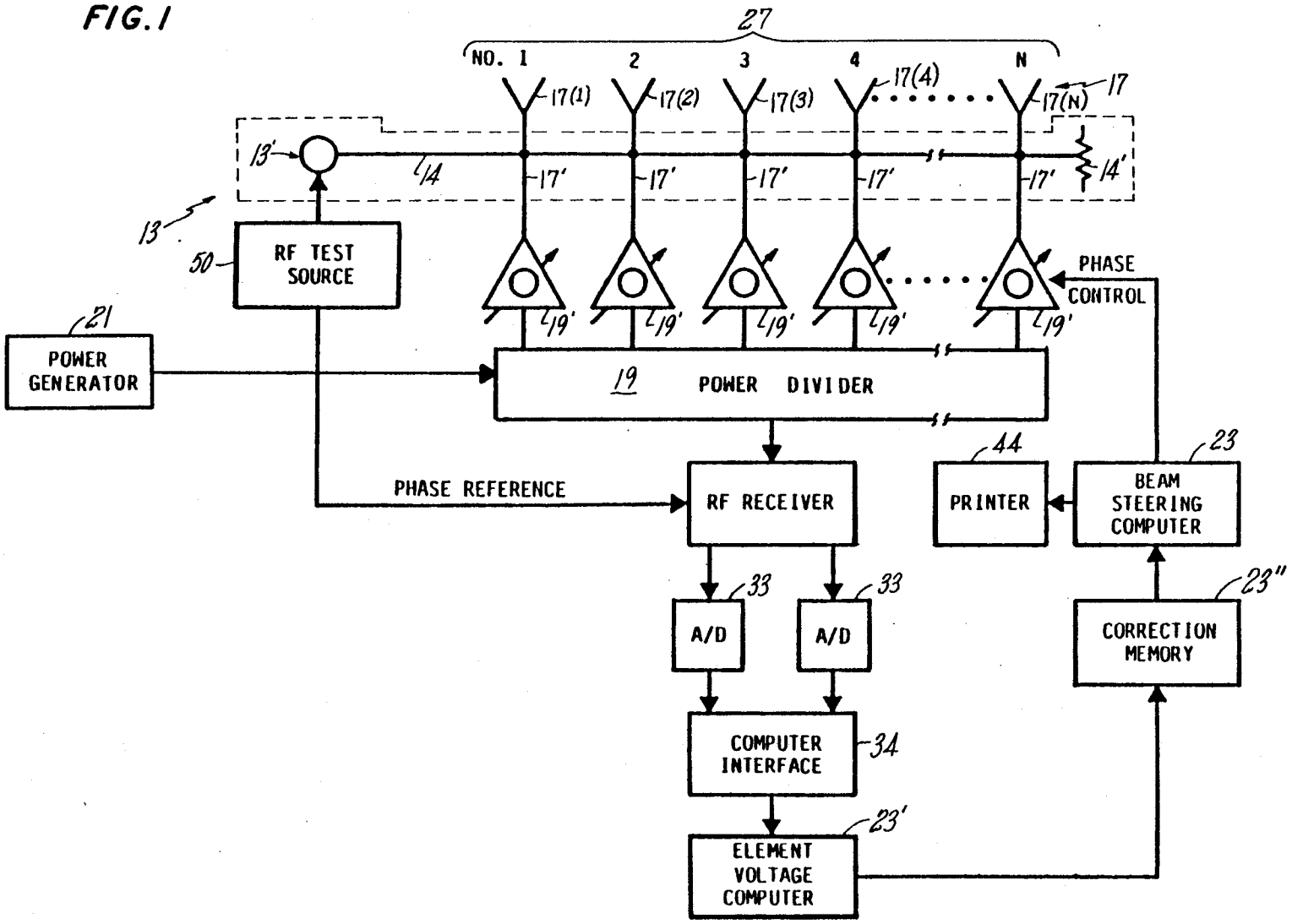
FIG. 1 shows a schematic of the antenna and beam steering system including the invention addressed herein.

FIG. 1 shows an electronically scanable antenna system 13 according to the invention herein. The system 13 includes a plurality of radiating elements 17 comprising aperture 27, which are supplied with electromagnetic energy from a power divider 19 in the nature of a corporate feed for example. The power provided to the divider 19 is generated in a radio frequency (RF) power generator 21 such as a magnetron for example. Once the power is transmitted through the divider 19, it is subject to phase controllers, i.e. phasers 19', under direction of beam steering computer 23.

From the phasers 19', the power is transmitted through respective elements 17 of aperture 27 toward a target region (not shown).

The return of reflected power from the target region or injected power is however detected by antenna 13 between power divider 19 and element 17. Coupling of the injected power is accomplished by small coupling apertures 13'' in coupler 13' communicating with the waveguides 17' connecting phasers 19' with radiating elements 17, thereby causing no more than a negligible perturbation in the received radar signal. The feed structure 13' in particular includes a transmission line 14, ending in a matched termination 14' Equally spaced, identical coupling apertures 13'' join feed structure 13' with antenna system 13. These have about −=dB coupling values.

Thus, the transmission line 14 of BITE feed structure 13' including the equally spaced couplers 13'' excites the radiating elements 17 with an injected signal of approximately equal amplitude and a linear phase taper.

The former is assured by the low coupling value, since even for a thousand element array, the excitation level varies only a few tenths of a dB between the first and the last one of elements 17. The latter is due to the equal spacing and resulting uniform phase incrementation.

A convenient implementation of coupler 13', as noted above, might for example be a waveguide transmission line 14 with a series of small coupling holes 13''. This arrangement would cause a signal injected into the traveling wave feed 13' to simulate a far-field signal from an angular direction "theta", measured from a direction normal to the aperture 27, where "theta" is the free space angle of the radiated signal, divided by the guide wavelength. For practical cases "theta" is about 45 degrees.

The purpose of the traveling wave feed 13', also known as a BITE coupler system as indicated below, is to simulate far-field signal reception without the aid of an antenna range or a near-field probe in front of the aperture 27. It is further possible to vary the angle-of-view of the simulated far-field reception by means of the electronic phasers 19'. For each angle-of-view, a particular set of uniformly incremented phaser settings can be computed.

Theory of Operation

The alignment sequence according to a version of the invention starts for example with the computation of a preferred set of "n" angle-of-view information where "n" denotes the quantity of elements of the antenna array so that the algorithm suggested below may be used for the computation of element voltages and phase settings.

The algorithm, which is derived at a later point of this description, directs the respective phasers 19' to apply a phase shift "$phi_k$" equal to [2pi][k][S/lambda][sin(-$theta_m$)−lambda/$lambda_g$],
where "S" is the distance between adjacent elements 17, "$lambda_g$" is the guide wavelength in the BITE coupler waveguide 13', "lambda" is the operating wavelength transmitted by radar system 13, "$theta_m$" is the selected angle-of-view of a hypothetical object detected during test measurement, and "k" is the index value of the particular phaser subject to the setting "$phi_k$", in this case there being 36 settings "k".

From this set of angles-of-view to the elements 17, a group of phaser settings for all radiating elements and all target angles can be established.

The test procedure calls for stepping all phasers 19' through these computed phase settings to simulate "n" sequential angles-of-view at the aperture 27 for an array of radiator elements 19. This is suggested in detail with respect to the flow chart in FIG. 2.

In particular, the phasers 19' are effective for conducting an electronic scan through for "n" scan angles, of the BITE coupler injected signal. During this electronic scan through "n" angles-of-view, information with respect to amplitude and phases of the simulated target at about 45 degrees is feed to Element Voltage Computer 23' via A/D converters 33, and a computer interface unit 34.

There the algorithm, which will be discussed below, is used to compute element voltages and phases to be applied and the results of the calculation performed are stored in the element voltage correction memory 23''.

Amplitude values are compared to the designed aperture illumination voltages with resulting dB error fed to a printer 44 for recording the information.

Phase values are compared to a constant zero value and the resulting errors fed to the printer and the beam steering computer 23. The latter causes these values of computed element phase to be subtracted from the commanded phase value to each phaser. This subtraction intends to compensate the measured phase error by means of a modified phaser settings.

The entire cycle of electronic scan, phase/amplitude measurement, element voltage compensation and phase error compensation in the beam steering computer 23 is repeated several times to asymptotically arrive at a compensated uniformly phased aperture 27. Depending upon computer speed, the entire process requires only a few seconds.

At the end of this process, the quality of the alignment may be displayed via the printer. For example, all element phase and amplitude errors or the measured electronic radiation patterns may be outputted. A simpler output would give mean and average sidelobe level as well as the location and error values for only those elements exceeding a predetermined threshold. Thus, antenna pattern quality may be quickly assessed and any faulty elements 17 quickly identified.

Beam steering computer 23 is effective for adjusting phase shifters 19' which control the phase of radiation passing through radiating elements 17. These radiating elements comprise the aperture 27 of the antenna, and are effective for receiving as well as sending electromagnetic signals.

As suggested, FIG. 1 additionally shows waveguide transmission line 14, which acts according to the invention herein to communicate with each of the radiating elements in the manner to be discussed below. The waveguide 14 in particular defines a plurality of non-directional or directional coupling holes 13'' which communicate with respective or corresponding ones of said radiating elements 17.

With regard to the aforementioned algorithm, computer 23 then adjusts the phase of the respective phase shifters according to the following relationship:

$$phi_k=[2 pi][k][S/lambda][sin(theta_m)-lambda/lambda_g],$$

where "k" is the number of the radiating element in the array; and "$theta_m$" is the angle-of-view applied to the radiating aperture and "S" is the separation between radiating element 17, all as before. The term lambda/-$lambda_g$ of the above equation corrects for phase delays in the BITE coupler.

For each angle-of-view generated by this relationship a complex return vector can be measured at the output of power divider 19. This complex return vector Vm equals the sum from K=1 to K=n of the expression $V_k$, *exp (j(n/2+0.5−k)(2pi S/lambda)sin($theta_m$), where $V_k$ is the complex return vector received by a single radiating element and the remaining quantities, "m", "n", "$theta_m$" and "lambda" are defined as indlcated above. If the angles-of-view ($theta_m$) are selected such that there is a linear sine progression from negative to positive ninety degrees (90°), by using defining expresion sin($theta_m$) equals (lambda/2nS)(n+1−2m), it is possible to solve for $V_k$ by a simplified matrix inversion. The complex return vector for the kth radiating element can now be calculated as the sum from m=1 to m=n of expression Vm *exp(−j(n/2+0.5−k)(-2pi/n)(n/2+0.5−m)).

The calculated phase of each element is then subtracted from the previous alignment value used to obtain the measured voltages.

During a first cycle of this operation, the calculated phase of each element is subtracted from zero. Each radiating element is then set to this new alignment phase value. After five repetitions of this operation, i.e. after five operation cycles, alignment is essentially completed, within the tolerance level desired, and the alignment phase and amplitude values determined can be computer stored for later reference and review.

The beam scanning computer 23 preferably employed is an HP9825. This computer was also used for the complex voltage measurements and calculations suggested above. Three degrees (3°), one standard deviation, phase alignment accuracy can be obtained in this fashion. The arrangement described above can in selected circumstances hold the maximum sidelobe radiation pattern of antenna 13 measured far-field to −33dB.

The automated, electronic "in-flight" aperture alignment technique according to the invention herein departs from Mr. Davis' approach by eliminating both the requirement for a rotating positioner as well as for a far-field radiated signal, but it retains his technique for phase and amplitude measurement at the antenna input port as well as his algorithm.

Figure 2:
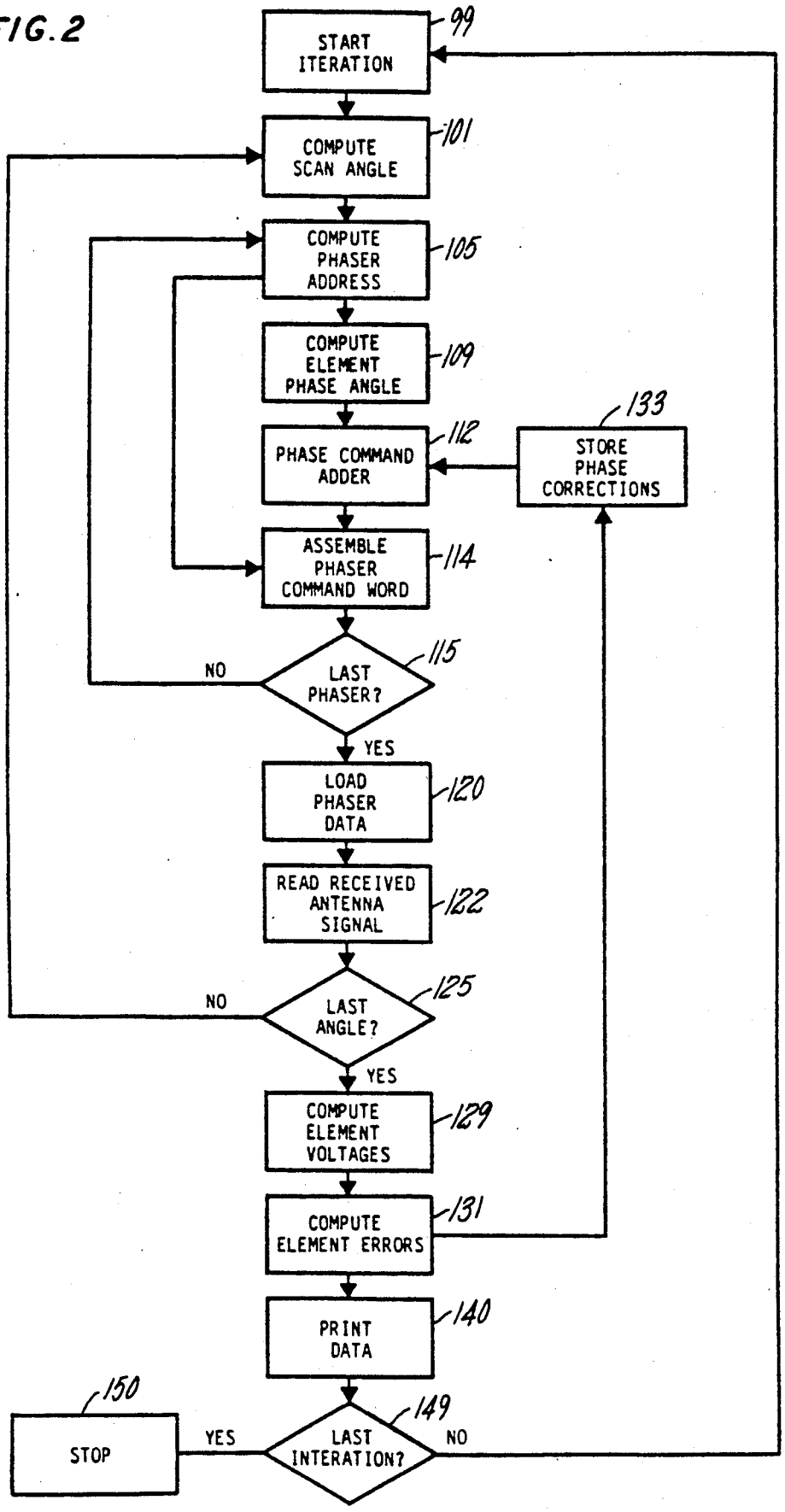
FIG. 2 is a flow chart showing operation of the antenna according to the invention.

FIG. 2 shows a possible technique for phase alignment according to the invention disclosed herein. In particular, according to a first step represented by block 101, a first scan angle (or angle-of-view) is determined by computation.

As discussed above, individual scan angles are determinable according to the equation, $theta_m$=arcsin[-(lambda/2nS)(n+1−2m)]. Lambda is of course the nominal transmitted wavelength; n is the number of radiating elements; S is the spacing or distance between elements; and "m" is a selected number between 1 and n, permitting there to be a total of n scan angles, with m=1 designating the first scan angle.

Simply stated, the total number of scan angles is equal to the number of elements in the array, i.e. "n". Rather than incrementing the scan angles themselves along equal distance increments, the sines of the angle increments are equal in value. This simplifies the determination of individual element excitation voltages, $V_k$, as shown previously.

At each particular scan angle, it is necessary to determine the setting for each of the phasers 19'. For each phaser, its address is determined as suggested at block 105. Then, the setting for the particular phaser, i.e. its phase angle, is determined to establish the amount of phase shift it is to apply to signals it transmits.

To this established phase angle there is then added a phase correction value, which has already been stored in memory 23''. Initially, the phase correction from memory 23'' will be zero, as it is assumed that no phase correction is initially required, since the computed phase angle is to be the actual phase correction to be applied in the beginning. The correction value, be it zero or otherwise, and the computed value are however nonetheless added, as suggested at block 112.

Next, the phaser address and the corrected element phase angle or value are assembled or combined into a single word. For the first scan angle, such an assembled word is determined for each of the phasers 19', combining address and setting. Block 115 insures that each phaser will have a word established to determine its setting.

Once all of this phaser data has been established it is loaded into the phasers 19' causing them to actually apply the desired phase settings to the phasers 19' themselves. A test signal from RF test source 50 sent to phasers 19' will then of course be capable of being processed by antenna 13.

Thus, as suggested at block 122, the received antenna signal will be read by the RF receiver 13 seen in FIG. 1. Such a received antenna signal is taken for each scan angle, to establish a matrix of information from which voltage excitations for each element can be calculated as suggested in Block 129. The difference between the calculated and specified element voltages, in terms of phase, gives an indication of what the actual phase correction should be as performed in block 131. These errors are stored as phase corrections in correction memory 23'' as in turn suggested at block 133.

The information regarding corrections established can further be documented in a print-out as indicated at block 140. A predetermined number of iterations, producing increasing degrees of refinement in the accuracy of the phase corrections can be taken, according to block 149 and 150, before operation is completed. The corrections thus established insure that accurate correction settings for the phasers will have been established in memory 23'' for actual operation.

Individuals skilled in the art are likely to conceive of variations of the above, which nonetheless fall within the scope of the invention addressed herein. Accordingly, attention to the claims which follow is urged, as these alone authoritatively and with legal effect set forth the metes and bounds of the invention.

We claim:

1. A radar system comprising:

an rf power generator;

an antenna having a plurality of radiating elements;

a corresponding plurality of controllable phase adjustment means for adjusting the phase of rf power coupled into said radiating elements, whereby a beam direction of radiation emitted from said antenna may be steered by phase control;

rf receiver means for receiving radar return signals detected by said antenna and passing through said plurality of phase adjustment means;

adjustable phase control means for controlling said controllable phase adjustment means;

test means for generating an rf test signal;

test distribution means for distributing said rf test signal to predetermined components of said radar system;

means for forming a set of correction parameters to said controllable phase adjustment means; and means for automatically adjusting said adjustable phase control means in accordance with said set of correction parameters, whereby said phase control means may be calibrated;

characterized in that:

said antenna is a corporate feed antenna, whereby signals pass along connecting conductive elements between said antenna, said plurality of output power connecting means and said rf power generator;

said test distribution means is connected to a set of output power connecting means connected between said rf power generator and said plurality of radiating elements by connecting conductive elements;

said test distribution means includes means adapted to couple a plurality of related signals to individual ones of said controllable phase adjustment means;

said test distribution means is connected to said test means and to a plurality of output power connecting means connected between said phase adjusting means and said radiating elements and distributes said rf test signal to said output power connecting means to simulate a radar return signal entering said plurality of radiating elements from a simulated source direction; and said means for forming a set of correction parameters to said controllable phase adjustment means includes means for storing a plurality of output signals from said plurality of phase adjustment means at each of a plurality of simulated source directions and generating therefrom said set of correction parameters.

2. A radar system according to claim 1, further characterized in that said test distribution means comprises a, constant amplitude linear phase traveling feed loosely coupled to said plurality of output power connecting means.

* * * * *